US005092700A

United States Patent [19]

Susini et al.

[11] Patent Number: 5,092,700

[45] Date of Patent: Mar. 3, 1992

[54] ARTICLE FOR PACKAGING FUSIBLE SUBSTANCES, A PACKAGE OBTAINED WITH SAID ARTICLE, AND A METHOD FOR THE MANUFACTURE OF SAID PACKAGE

[75] Inventors: Claude Susini, Sennecy le Grand; Pascal Mejean, Veyrier du Lac, both of France

[73] Assignee: Reboul-SMT, France

[21] Appl. No.: 628,964

[22] Filed: Dec. 11, 1990

[30] Foreign Application Priority Data

Dec. 13, 1989 [FR] France ..... 89 16460

[51] Int. Cl.[5] ..... A45D 40/16; A45D 40/22

[52] U.S. Cl. ..... 401/98; 401/49; 401/88

[58] Field of Search ..... 401/49, 88, 98, 68, 401/72; 132/320

[56] References Cited

U.S. PATENT DOCUMENTS

| | | | |
|---|---|---|---|
| 4,235,557 | 1/1980 | Hayes | 401/49 |
| 4,369,158 | 1/1983 | Woodruff et al. | 401/68 X |
| 4,690,271 | 9/1987 | Zak | 200/1.7 |
| 4,794,936 | 1/1989 | Zango | 132/320 |
| 5,046,875 | 9/1991 | Skolnik | 401/49 |

FOREIGN PATENT DOCUMENTS

| | | | |
|---|---|---|---|
| 0315937 | 5/1989 | European Pat. Off. . | |
| 1270008 | 7/1961 | France . | |
| 2648333 | 12/1990 | France | 401/49 |
| 888612 | 1/1962 | United Kingdom . | |
| 2158043 | 11/1985 | United Kingdom . | |

*Primary Examiner*—Danton D. DeMille

*Attorney, Agent, or Firm*—Finnegan, Henderson, Farabow, Garrett & Dunner

[57] ABSTRACT

A single-use article for packaging fusible substances, in particular for sampling purposes, can be formed in one piece and has a tubular stem. One end of the stem terminates in a perforated dome which supports a thin layer of substance to be sampled and carries a removable cover.

11 Claims, 2 Drawing Sheets

ARTICLE FOR PACKAGING FUSIBLE SUBSTANCES, A PACKAGE OBTAINED WITH SAID ARTICLE, AND A METHOD FOR THE MANUFACTURE OF SAID PACKAGE

BACKGROUND OF THE INVENTION

1. Field of the Invention

The present invention relates to the packaging industry, more particularly for packaging fusible substances which are normally semi-rigid at the usual ambient temperatures, such as lipsticks and other cosmetics or pharmaceutical products or household cleaning products. The invention is more precisely concerned with the packaging of such substances in small quantities, especially for sampling and for a single use.

2. Description of the Prior Art

It has already been proposed to sample lipstick in the form of a small stick, one end of which is coated with paste by dipping in the same manner as matches, as described in French patent No. 1,270,008. But this limited presentation of lipstick is unsuitable for testing standard commercially available lipstick under normal conditions on account of the fact that it has neither the same surface nor the same shape and does not permit full appreciation of the color and appearance of the standard lipstick.

It has also been proposed to mold in a bowl-shaped mold, solid substances which are fluidified in the hot state such as antiperspirant products, then to dip a perforated cup superficially in the mass which is still in the liquid state and is subsequently allowed to cool and to solidify, whereupon said cup is fixed on the end of a handle which will facilitate handling of the solid block for applications on the body, as described in U.S. Pat. No. 4,235,557. However, this type of package calls for the use of quantities of substance which are too large for a sampling operation.

SUMMARY OF THE INVENTION

The present invention is concerned with the packaging of small quantities of thermofusible substances for a single use and especially a sampling operation, in a simple and inexpensive package which can readily be mass-produced, which entails the use of only an extremely small quantity of substance, and which nevertheless offers the appearance and shape of the end of the stick of substance as normally marketed.

The invention is directed to a single-use article for the individual packaging of a small quantity of fusible substance to be applied on a surface by manual friction. Said article comprises a tubular stem open at one end and terminating at the other end in a perforated dome for supporting the substance in a thin layer over its entire surface, the base of said dome being provided externally with means for supporting a movable cover in a fluid-tight manner, the internal ogival cavity of said cover being located in spaced relation to the external surface of the dome at a short distance which determines the thickness of the layer of substance.

The cover can advantageously be molded in one piece with the tubular stem and is joined thereto by means of an articulation tongue which is capable of folding and unfolding so as to permit engagement of the cover on the base of the dome and subsequent disengagement of said cover in order to use the article.

In order to prevent any impairment in air during storage, the article considered can be completed by a plug for sealing the open end of the tubular stem. This seal plug can be molded in one piece with the stem and can be joined to this latter by means of a folding articulation strip or else said plug can constitute a separate part which may be inserted within and at the inner end of the tubular stem.

The seal plug can be constituted by an external decorative case which covers the tubular stem, said case being associated with a complementary decorative cap which is placed over the cover and fixed on this latter.

An article in accordance with the invention can be associated with a display stand, the base of which offers a plurality of supports for a corresponding number of articles.

In order to ensure a presentation which is identical with the commercial product, the ogival cavity of the cover will have the same shape as the molded end of the corresponding cosmetic stick and in particular a lipstick.

It is usually an advantage, especially for packaging colored substances and in particular of cosmetics, to ensure that at least the cover is of transparent material so that it may thus be possible to appreciate the coloring of the substance without any need to withdraw the cover.

The invention is also concerned with a package, in particular for sampling a small quantity of fusible substances to be applied on a surface by manual friction, especially of cosmetics, pharmaceutical products and household cleaning products. Said package is essentially constituted by an article as considered in the foregoing in which the space between the cover and the dome as well as at least part of the interior of the dome are filled with the packaged substance.

The invention is also directed to a method of manufacture of the package under consideration in which the substance to be packaged is fluidified, then poured into the article with the cover engaged on the dome until the space between the cover and the dome as well as the interior of the dome have been filled while leaving the remainder of the tubular stem empty, the substance being finally allowed to solidify by cooling within the article.

DETAILED DESCRIPTION OF THE INVENTION

Figure 1:
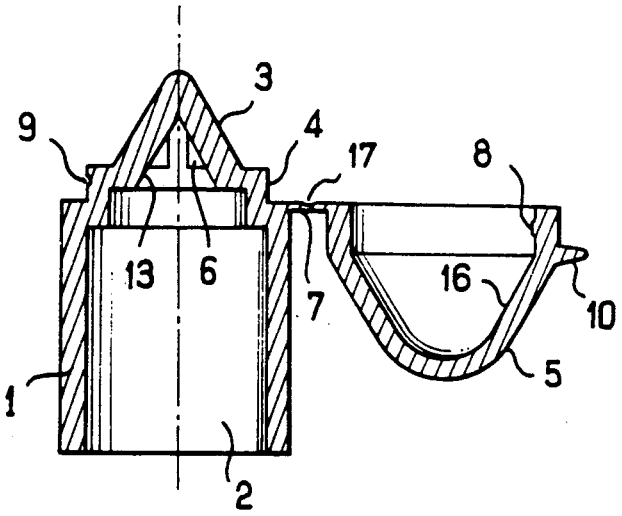
FIG. 1 is a schematic view, in elevation and in diametral cross-section, of an article in accordance with the invention and shown after removal from the mold with its lateral cover.

In these figures, corresponding elements are designated by the same reference numerals which may be followed by an index. The respective dimensions and proportions of these elements may not be complied with for the sake of enhanced clarity of the drawings.

Figure 2:
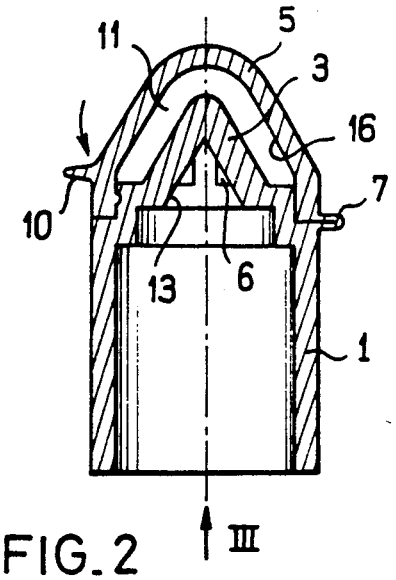
FIG. 2 is a view which is similar to that of FIG. 1 and shows the same article with the cover engaged on the dome.

The article in accordance with the invention as illustrated in the figures essentially comprises a tubular stem 1 molded in one piece and made, for example, of polyethylene or polypropylene which is preferably transparent. Said tubular stem 1 is open at one end 2 and terminates at the other end in a conical dome 3 pierced by four lateral openings 6*a*, 6*b*, 6*c*, 6*d*, the cylindrical base 4 of which serves as a fluid-tight support for the engagement of the corresponding base of a cover 5. Said cover is attached to the tubular stem 1 by means of a hinged connection in the form of a folding tongue 7 which is molded in one piece with the stem 1 and its dome 3 as shown in FIG. 1. A small raised portion 8 within the cover 5, on the side opposite to the tongue 7, is adapted to cooperate with a corresponding cavity 9 of the base 4 of the dome 3 so as to maintain the cover 5 closed down on the dome 3 as shown in FIG. 2. A radial lug 10 which projects from the base of the cover 5 facilitates handling of this latter for the purpose of closing-down the cover (FIG. 2) and subsequent withdrawal of this latter at the time of use (FIG. 5) as indicated by arrows in these figures. Between the dome 3 and the closed-down cover 5, there remains an empty space 11 having a substantially constant clearance.

Figure 3:
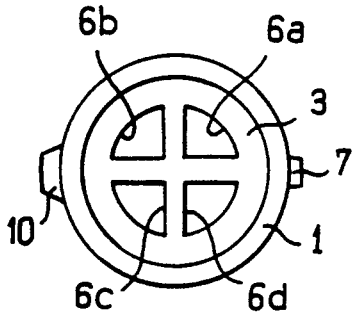
FIG. 3 is a schematic bottom view, looking in the direction of the arrow III of FIG. 2.
Figure 4:
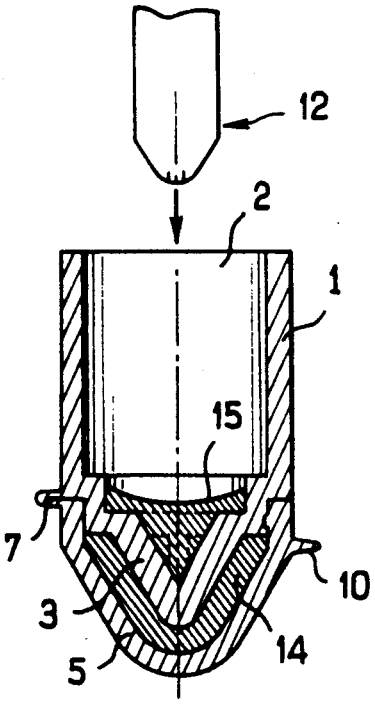
FIG. 4 is a schematic view in elevation and in diametral cross-section showing the packaging of a fluid substance in the article of FIGS. 1 to 3.

After molding of the assembly (FIG. 1), the cover 5 is closed down on the dome 3 (FIG. 3), whereupon the substance to be packaged which has previously been fluidified by heating is then poured by means of a nozzle 12 through the open end 2 of the tubular stem 1 until the space 11 between the dome 3 and the cover 5 as well as the interior 13 of the dome (FIG. 4) are filled, thus ensuring that, after solidification of the substance, its useful layer 14 which is located outside the dome 3 is well anchored to its bottom portion 15 located inside the dome 3 through the openings 6 of the dome. The ogival internal cavity 16 of the cover 3 serves as a mold for the outer portion of the layer 14 of substance. Preferably in the case of cosmetics, said internal cavity has the same shape (a conventional ogive of revolution, a cant face, a dihedron or the like) as the useful end of the commercially available stick of the same substance. Thus, after withdrawal of the cover 5 (FIG. 5), the user of the package thus formed is provided with the same conformation of the substance for a test as the commercial stick which the user can purchase.

If necessary, the tongue 7 can be made breakable by means of a reduced-strength zone 17 which facilitates folding of the tongue and serves to separate the cover from the remainder of the article for greater ease of access to the layer of substance 14 at the time of use.

The package (FIG. 5) formed by pouring a substance (FIG. 4) into an article (FIGS. 1 to 3) can be completed by a seal plug 18 (FIG. 6) which is introduced in the open end 2 of the tubular stem 1. Said plug 18 is advantageously provided with a flange 19 having the same external diameter as the stem 1. It endows the tubular stem with greater rigidity and gives the package a more attractive appearance while protecting the bottom portion 15 of substance against any degradation produced by the atmosphere.

Figure 6:
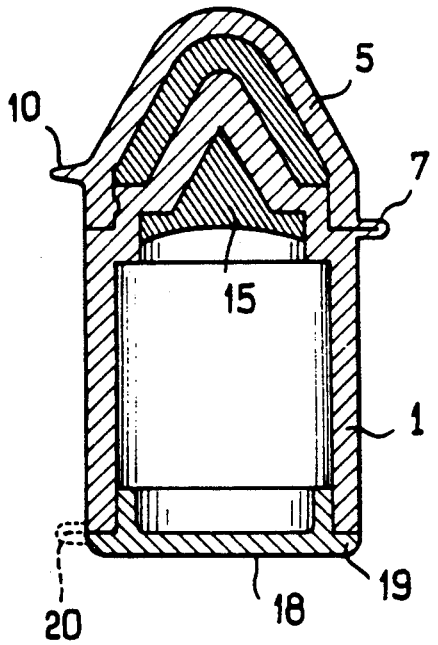
FIG. 6 is a schematic view in elevation and in diametral cross-section showing the package of FIGS. 4 and 5, said package being equipped with a seal plug.

The seal plug 18 can consist of a separate part as shown in full lines in FIG. 6 or else can be molded in one piece with the remainder of the article if it is attached to the tubular stem 1 by means of a folding strip 20 which is similar to the tongue 7 of the cover 3, as indicated in dotted outline in FIG. 6.

Figure 5:
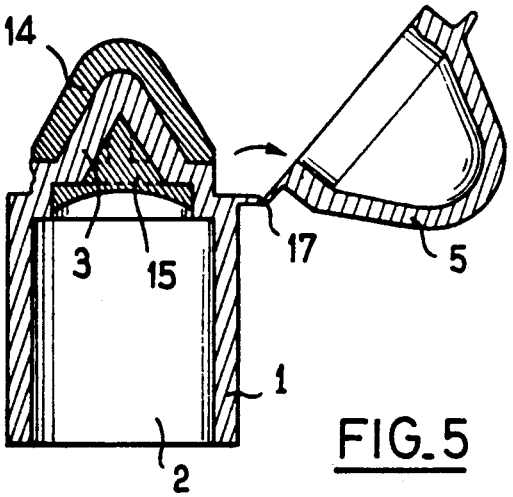
FIG. 5 is a schematic view in elevation and in diametral cross-section showing the package of FIG. 4, the cover being folded-back to one side in readiness for use.
Figure 7:
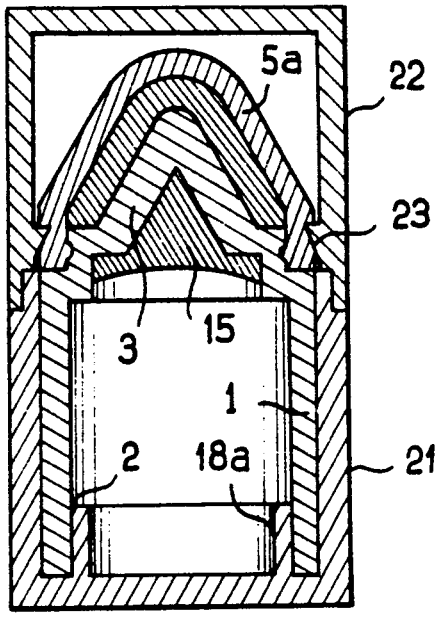
FIG. 7 is a schematic view in elevation and in diametral cross-section showing a package which is similar to that of FIGS. 5 and 6 and is inserted within an assembly consisting of a decorative case and cap.

The package illustrated in FIG. 7 is similar to that of FIGS. 5 and 6 but the tubular stem 1 is covered with a decorative case 21, the blind base of which engages in the open end 2 of the tubular stem so as to form an end-plug 18*a*. A decorative cap 22 is removably fitted on the open end of the case 21 and thus completes this latter. Said cap is provided with an internal rib 23 having a frusto-conical cross-section which is snap-actingly engaged in a complementary groove of the base of the cover 5*a* to which the cap is thus secured. In this embodiment, the cover 5*a* is independent of the tubular stem 1 and of the dome 3.

Figure 8:
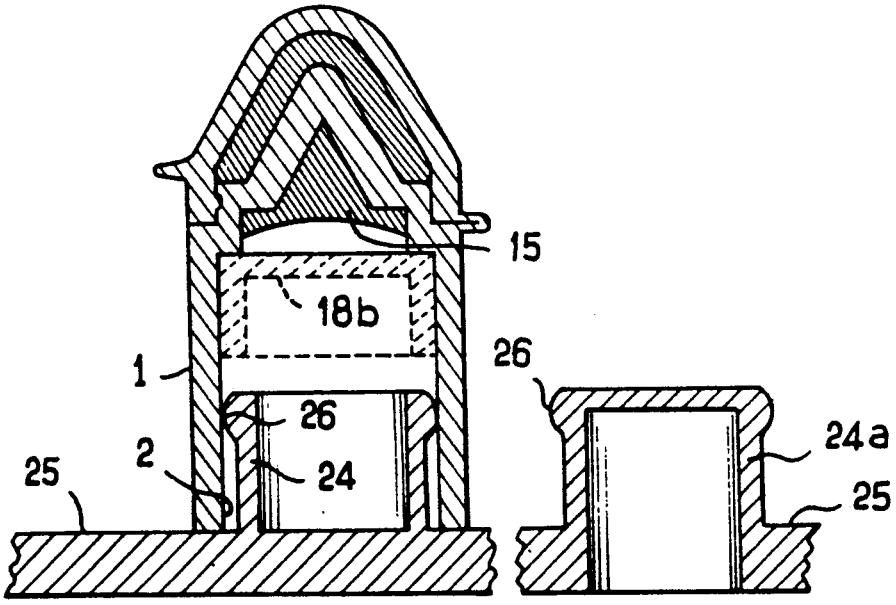
FIG. 8 is a schematic view in elevation and in diametral cross-section in which an article as shown in FIGS. 1 to 5 is mounted on a multiple display support.

FIG. 8 illustrates a package which is similar to that of FIGS. 5 and 6. In this case the open end 2 of the tubular stem 1 is removably engaged on a tubular nipple 24 which extends upwards from one face of a plate 25 forming a display stand for a plurality of similar packages. The nipples can be open (24) or closed (24*a*). Each nipple can advantageously have an external annular rim 26 at that end which is introduced into the tubular stem of a package in order to ensure that this latter can be more effectively maintained on the nipple while being easy to insert and to withdraw. Complementary protection of the bottom portion 15 of substance against the external atmosphere can be provided by a plug 18*b* which is inserted in the inner end of the tubular stem 1 as indicated in dashed outline in FIG. 8.

What is claimed is:

1. A single-use article for the individual packaging of a small quantity of fusible substance to be applied on a surface by manual friction, wherein said article comprises a tubular stem open at one end and terminating at the other end in a perforated dome for supporting the substance in a thin layer over its entire surface, the base of said dome being provided externally with means for supporting a removable cover in a fluid-tight manner, the internal ogival cavity of said cover being located in spaced relation to the external surface of the dome at a short distance which determines the thickness of the layer of substance.

2. An article according to claim 1, wherein the cover is molded in one piece with the tubular stem and joined thereto by means of an articulation tongue which is capable of folding and unfolding so as to permit engagement of the cover on the base of the dome and subsequent disengagement of said cover in order to use the article.

3. An article according to claim 1, wherein said article comprises a plug for sealing the open end of the tubular stem.

4. An article according to claim 3, wherein the seal plug is molded in one piece with the tubular stem and joined thereto by means of a folding articulation strip.

5. An article according to claim 3, wherein the seal plug is inserted within and at the inner end of the tubular stem.

6. An article according to claim 3, wherein the seal plug is constituted by an external decorative case which covers the tubular stem, said case being associated with a complementary decorative cap which is placed over the cover and fixed thereon.

7. An article according to claim 1, wherein said article is associated with a display base which offers a plurality of supports for a corresponding number of articles.

8. An article according to claim 1, wherein the ogival cavity of the cover has the same shape as the molded end of a cosmetic stick and especially a lipstick.

9. An article according to claim 1, wherein at least the cover is of transparent material.

10. A package, in particular for sampling a small quantity of fusible substances to be applied on a surface by manual friction, especially of cosmetics, pharmaceutical products and household cleaning products, wherein said package is constituted by an article according to claim 1,. wherein the space between the cover and the dome as well as at least part of the interior of the dome are filled with the packaged substance.

11. A method of fabrication of the package according to claim 10, wherein the substance to be packaged is fluidified, wherein said substance is poured into the article with the cover engaged on the dome, until the space between the cover and the dome as well as the interior of the dome are filled so as to leave the remainder of the tubular stem empty, and wherein the substance is allowed to solidify by cooling within the article.

* * * * *